US007661363B2

(12) United States Patent
Cotet et al.

(10) Patent No.: US 7,661,363 B2
(45) Date of Patent: Feb. 16, 2010

(54) IMPACT FUSE

(75) Inventors: Stéphane Cotet, Bourges (FR); Laurent Desgland, Les Aix d'Angillon (FR); Nicolas Eches, Plaimpied Givaudins (FR)

(73) Assignee: Nexter Munitions, Versailles (FR)

( * ) Notice: Subject to any disclaimer, the term of this patent is extended or adjusted under 35 U.S.C. 154(b) by 0 days.

(21) Appl. No.: 11/822,400

(22) Filed: Jul. 5, 2007

(65) Prior Publication Data

US 2008/0011178 A1 Jan. 17, 2008

(30) Foreign Application Priority Data

Jul. 13, 2006 (FR) ..... 06 06449

(51) Int. Cl.
*F42C 11/02* (2006.01)

(52) U.S. Cl. ..... 102/210; 102/204; 102/272; 102/275

(58) Field of Classification Search ..... 102/204, 102/210, 202.5, 272, 275
See application file for complete search history.

(56) References Cited

U.S. PATENT DOCUMENTS 2,827,851 A * 3/1958 Ferrara ..... 102/210
2,900,906 A * 8/1959 Olsen ..... 102/378
3,324,317 A * 6/1967 Hazelet ..... 310/329
3,585,419 A * 6/1971 Andre ..... 310/339
3,842,742 A * 10/1974 Harnau ..... 102/210
3,967,141 A * 6/1976 Gawlick et al. ..... 310/339
3,987,729 A * 10/1976 Andrews et al. ..... 102/210
4,026,214 A * 5/1977 Backstein ..... 102/210
4,434,717 A * 3/1984 Erickson ..... 102/210
4,648,320 A * 3/1987 Furst et al. ..... 102/210
5,033,382 A * 7/1991 Webb ..... 102/235
5,040,463 A * 8/1991 Beaverson ..... 102/210
5,536,990 A * 7/1996 Nelson ..... 310/339
7,117,796 B1 * 10/2006 Bogle et al. ..... 102/275.6

FOREIGN PATENT DOCUMENTS

EP 0 161 460 A1 11/1985
FR 1 595 412 7/1970
FR 2 124 907 A 9/1972
FR 2 669 416 5/1992
FR 2669416 A1 * 5/1992
WO WO 85/03345 8/1985

* cited by examiner

*Primary Examiner*—Stephen M Johnson
*Assistant Examiner*—Daniel J Troy
(74) *Attorney, Agent, or Firm*—Oliff & Berridge, PLC

(57) ABSTRACT

An impact fuse includes a body containing a piezoelectric generator positioned on a bracket integral with the body. The piezoelectric generator serving as an anvil. The fuse includes a piston intended to mechanically contact the generator upon impact. The piston receives the impact forces transmitted by a cap. The fuse being characterized in that the piston is slidably fitted within the body and in that it includes plastically deformable means that are interposed between the cap and the body. The means are deformed by cap movement upon impact with a target via piston movement. The plastically deformable means is configured to be deformed in a manner that causes the piston to more gradually exert force on the piezoelectric generator.

3 Claims, 1 Drawing Sheet

IMPACT FUSE

BACKGROUND

The technical field of the invention is that of impact fuses for projectiles. It is known to produce impact fuses that include a piezoelectric generator for generating an electrical voltage upon the fuse impacting a target.

Conventionally, piezoelectric generators comprise one or several piezoelectric ceramics stacked on one another. Such a generator is placed on a bracket that is integral with the fuse body and the generator serves as an anvil.

In other respects, the fuse comprises a piston for mechanically contacting (exerting stress on) the generator upon impact. The FR-1595412 patent describes such a known impact fuse. The electrical voltage obtained from the generator is used to initiate an electrical primer.

One of the problems with the known fuses is that, under some impact conditions, the electrical voltage generated may be insufficient to ensure the initiation of the primer.

This is due to the fact that the shock received by the generator is too brief (the force on the generator is insufficient).

In other respects, initiation of the primer due to relatively low energy levels and/or detonation of the casing must be avoided.

Thus, contradictory conditions are present. On the one hand, a deformation of the generator sufficient to ensure a nominal electrical voltage allowing the initiation of the primer is needed. On the other hand, preventing any deformation of the generator at a reduced shock level is likewise needed.

The FR-2669416 patent describes a priming device that comprises a piezoelectric generator integral with the fuse body and is actuated by a hammer upon impact. At that time, the hammer is projected toward the piezoelectric generator as a result of the shockwave leaving from the cap. With such a concept, the shock received by the generator is all the same too brief. In other respects, the WO-85/03345 reference describes a percussion fuse comprising a piezoelectric generator and a means for enhancing safety. This means involves combining a self induction coil and a spark gap. Thus the firing is only caused when the rising edge of the received pulse exceeds a given amplitude.

The purpose of the fuse of this reference is different than that of the disclosed invention because the purpose of the reference is directed to a mechanical link for ensuring a high and brief pulse of the piston on the generator.

SUMMARY

It is the purpose of the invention to provide an impact fuse with a piezoelectric generator having enhanced initiation reliability while providing an optimal safety of use.

Thus, the invention relates to an impact fuse comprising a body containing a piezoelectric generator positioned on a bracket integral with the body. The piezoelectric generator serves as an anvil. The fuse comprises a piston intended to mechanically contact (exert stress on) the generator. The piston receives impact forces transmitted by a cap upon impact. The fuse being characterized in that the piston is slidably fitted within the body and in that it comprises plastically deformable means that are interposed between the cap and the body. The means being deformed by cap movement upon impacting a target via piston movement. Wherein the plastically deformable means is configured to be deformed upon impact in a manner that causes the piston to more gradually exert force on the piezoelectric generator, resulting in an increased likelihood that sufficient electrical voltage is generated by the piezoelectric generator, as compared to a transfer of force from the cap to the piezoelectric generator via the piston without a plastically deformable means being present.

The plastically deformable means may be a plastically deformable washer comprising at least one deformable rim formed on at least one surface of the washer. The washer may be made of metal. The metal washer may comprise at least two rims separated by at least one groove. In other respects, the washer may be made of aluminum or aluminum alloy.

BRIEF DESCRIPTION OF THE DRAWINGS

The invention will become better understood from the following description of a particular embodiment, with reference to the accompanying drawings, wherein.

DETAILED DESCRIPTION OF EMBODIMENTS

Figure 1:
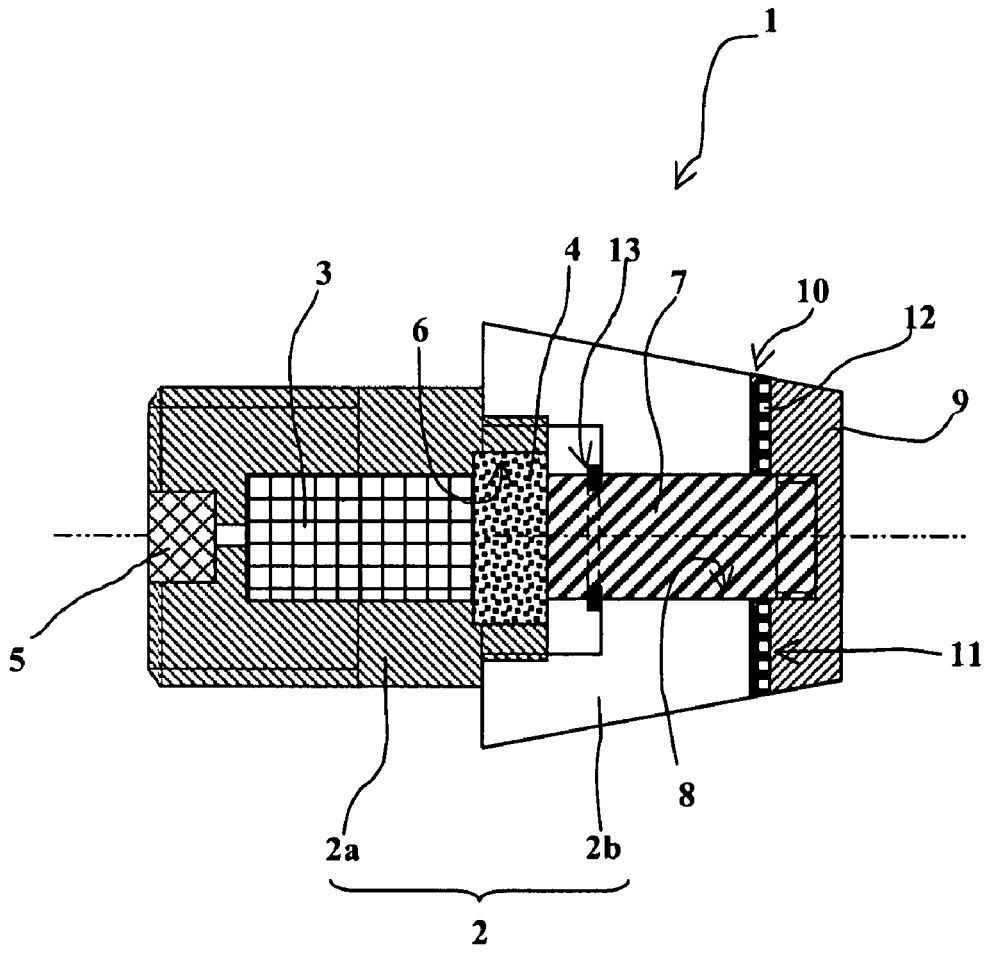
FIG. 1 is a diagrammatic longitudinal cross-sectional view of a fuse according to an embodiment of the invention.

FIG. 1 shows a head fuse 1 for a projectile. This Fuse 1 is intended to be provided on a front end of a projectile (not shown), such as, for example, an artillery or tank shell or a mortar projectile.

The fuse 1 comprises a body 2 having a threaded rear part 2*a*, which may be screwed to the projectile, and a truncated cone-shaped front part 2*b*. The rear part 2*a* contains an electronic circuit 3 that is connected on one side to a piezoelectric generator 4 and on the other side it is connected to a primer 5.

This electronic circuit does not constitute the object of the present invention and so will not be further described.

The piezoelectric generator 4 is provided within a housing 6 arranged at an end of the rear part 2*a* of the body 2. The rear part 2*a* of the body 2 thus constitutes an anvil-forming bracket.

The fuse 1 comprises a piston 7 that is slidably fitted into an axial bore 8 of the front part 2*b* of the body 2.

The piston 7 is intended to come to exert a mechanical stress on the generator 4 by contact and so the piston 7 comprises a surface facing the generator 4.

The piston 7 is coupled (for example, by screwing) with a cap 9 in which cap 9 extends from the front part 2*b* of the fuse body. Upon impacting a target, the cap 9 transmits force to the piston 7 that in turn conveys force to the piezoelectric generator 4.

In other respects, the piston is partly immobilized against translatory motions by a slit elastic ring 13 provided in a peripheral groove of the piston. This ring 13 avoids any extraction of the piston 7 out of its housing. On the other hand, it does not prevent the piston 7 from moving toward the generator 4. A ledge arranged on the piston 7 could replace the ring 13.

Figure 2:
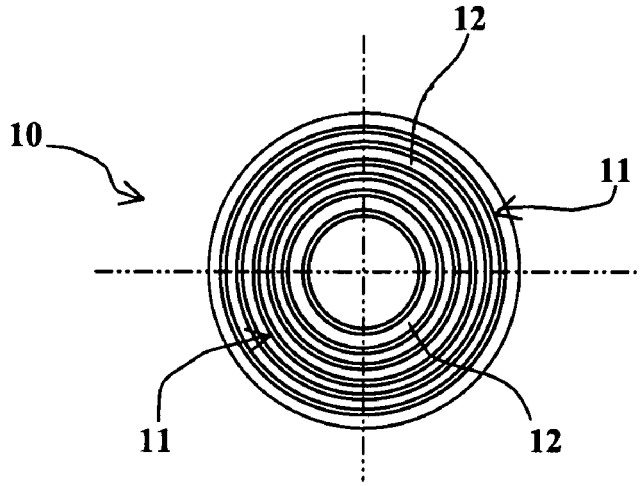
FIG. 2 is a front view of the washer implemented in this fuse.

According to the invention, the fuse comprises a plastically deformable means interposed between the cap 9 and the body 2. Those means are constituted by a metal washer 10 (made of aluminum or aluminum alloy) comprising at least one deformable rim 11. As may be more clearly seen from FIG. 2, the rims 11 are separated by circular grooves 12.

The washer material is chosen so that it is plastically deformable upon the fuse 1 impacting a target. Thus, the washer deformation is irreversible.

Further, plastic materials or materials that stay (under the shock conditions upon impacting a target) in an elastic deformation domain are excluded for forming the washer 10.

Those skilled in the art are readily able to size the rims 11 (number and thickness) according to the operational constraints that need met. In other respects, the washer 10 stiffness ensures the piston 7 immobilization during stocking, storage, and before impact during operation.

The rims 11 are sized so that they are only determined upon the fuse 1 impacting a target after an effective firing of the projectile. The energy consumed by the washer 10 deformation allows to ensure a longer and more gradual crushing of the piezoelectric generator 4. The result of this is a higher electric voltage and a better initiation reliability.

Various alternative embodiments may be designed without departing from the scope of the invention.

The washer 10 axial position relatively to the body 2 may thus be varied. It shall be noted that the further the washer 10 is positioned in the rear, the more sensitive the fuse 1 is to a grazing impact. In other respects, a conical interface may be provided between the piston 7 and the cap 9 (as described by the FR159412 patent).

An annular piston 7 may also be implemented (cooperating with an also annular piezoelectric generator) to allow, for example, the operation mode programming means to be provided at the fuse axis level.

The invention claimed is:

1. An impact fuse, comprising:

a body comprised of a front portion and a rear portion;

a piezoelectric generator housed proximate a first end of the rear portion forming an anvil;

a piston slidably fitted within the front portion of the body and in physical contact with the piezoelectric generator prior to impact, the piston configured to exert force on the piezoelectric generator upon impact;

a cap directly coupled to the piston by screwing, the cap configured to first contact a target upon impact and transmit impact forces to the piston; and a plastically deformable washer positioned between the cap and the front portion of the body, the cap and body being separated without directly contacting one another by the washer before impact, the washer comprising a plurality of concentric rims separated by a plurality of intermittent grooves;

wherein:

the rims are uniform in thickness;

the grooves are uniform in thickness;

the rims directly contact the cap; and the washer is configured to be deformed upon impact in a manner that causes the piston to more gradually exert force on the piezoelectric generator as compared to a transfer of force from the cap to the piezoelectric generator via the piston without a plastically deformable washer being so positioned.

2. The impact fuse of claim 1, wherein washer is made of metal.

3. The impact fuse of claim 2, wherein the washer is made of aluminum or an aluminum alloy.

* * * * *